US007678155B2

(12) United States Patent
Yamamoto et al.

(10) Patent No.: US 7,678,155 B2
(45) Date of Patent: Mar. 16, 2010

(54) WATER- AND OIL-REPELLENT TREATMENT OF TEXTILE

(75) Inventors: Ikuo Yamamoto, Settsu (JP); Kayo Kusumi, Settsu (JP); Mitsuhiro Usugaya, Settsu (JP); Ryosuke Hara, Settsu (JP); Takahito Kanbara, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 212 days.

(21) Appl. No.: 10/408,777

(22) Filed: Apr. 8, 2003

(65) Prior Publication Data

US 2004/0202818 A1 Oct. 14, 2004

(51) Int. Cl.
*D06M 11/07* (2006.01)
*D06M 11/58* (2006.01)
*D06M 13/53* (2006.01)

(52) U.S. Cl. ..... 8/115.6; 252/8.62; 427/315; 428/375

(58) Field of Classification Search ..... 427/315, 427/377, 493.4, 394, 430.1; 524/457; 8/115.64, 8/115.67, 115.6; 525/200; 428/375; 252/8.62
See application file for complete search history.

(56) References Cited

U.S. PATENT DOCUMENTS

| | | | | |
|---|---|---|---|---|
| 4,416,787 | A | 11/1983 | Marshall et al. | |
| 5,073,442 | A | 12/1991 | Knowlton et al. | |
| 5,516,337 | A | 5/1996 | Nguyen | |
| 5,520,962 | A | 5/1996 | Jones, Jr. | |
| 5,851,595 | A | 12/1998 | Jones, Jr. | |
| 6,048,941 | A * | 4/2000 | Yamana et al. | 525/200 |
| 6,197,378 | B1 * | 3/2001 | Clark et al. | 427/315 |
| 6,376,592 | B1 * | 4/2002 | Shimada et al. | 524/457 |
| 6,894,106 | B2 * | 5/2005 | Aga et al. | 524/544 |
| 2003/0106161 | A1 * | 6/2003 | Enomoto et al. | 8/115.51 |
| 2003/0115678 | A1 * | 6/2003 | Enomoto et al. | 8/115.51 |

FOREIGN PATENT DOCUMENTS

| | | | |
|---|---|---|---|
| JP | 59-100770 | A | 6/1984 |
| WO | WO 98/50619 | A1 | 11/1998 |
| WO | 01/55499 | * | 8/2001 |
| WO | 01/81672 | * | 11/2001 |
| WO | 02/24828 | * | 11/2001 |

* cited by examiner

*Primary Examiner*—Lorna M Douyon
*Assistant Examiner*—Amina Khan
(74) *Attorney, Agent, or Firm*—Sughrue Mion, PLLC

(57) ABSTRACT

Excellent water- and oil-repellency and soil releasability can be obtained by a method of preparing a treated textile, having steps of:
(1) preparing a treatment liquid containing a water- and oil-repellent agent and a stain blocking agent,
(2) adjusting pH of the treatment liquid to at most 7,
(3) applying the treatment liquid to a textile,
(4) treating the textile with steam, and
(5) washing the textile with water and dehydrating the textile,
wherein the water- and oil-repellent agent contains at least one fluorine-containing compound selected from the group consisting of a fluorine-containing polymer and a fluorine-containing low molecular weight compound, and the water- and oil-repellent agent or the treatment liquid contains a cationic emulsifying agent.

12 Claims, No Drawings

WATER- AND OIL-REPELLENT TREATMENT OF TEXTILE

FIELD OF THE INVENTION

The present invention relates to a treatment for imparting excellent water-repellency, oil-repellency and soil releasability to a textile. A method of the present invention is particularly useful for a carpet.

BACKGROUND OF THE INVENTION

Hitherto, various treatment methods have been proposed in order to impart water-repellency, oil-repellency and soil releasability to a textile such as a carpet. For example, a process (hereinafter, sometimes referred to as "Exhaust process") of treating a textile comprising decreasing a pH of a treatment liquid, applying the treatment liquid to the textile, thermally treating the textile with steam, washing the textile with water, and dehydrating the textile is proposed.

A method comprising the Exhaust process is proposed in U.S. Pat. Nos. 5,073,442, 5,520,962, 5,516,337 and 5,851,595 and International Publication WO 98/50619.

U.S. Pat. No. 5,073,442 discloses a method of treating a textile, comprising conducting an Exhaust process by using a water- and oil-repellent agent comprising a fluorine-containing compound, a formaldehyde condensation product and an acrylic polymer. U.S. Pat. Nos. 5,520,962 and 5,851,595 disclose a method of treating a carpet, comprising conducting an Exhaust process by using a fluorine-containing compound and a polymeric binder. U.S. Pat. No. 5,516,337 discloses a method of treating a textile, comprising conducting an Exhaust process by using a fluorine-containing water- and oil-repellent agent and a metal compound such as aluminum sulfate. International Publication WO 98/50619 discloses a method of treating a carpet, comprising conducting an Exhaust process by using a fluorine-containing water- and oil-repellent agent and a salt such as a magnesium salt.

When these methods are used to conduct the Exhaust process with using mainly both of a stain blocking agent and a water- and oil-repellent agent and without using a cationic surfactant, so as to obtain sufficient water-repellency and oil-repellency.

DISCLOSURE OF THE INVENTION

An object of the present invention is to give a textile excellent in water-repellency and oil-repellency, when an Exhaust process is used.

The present invention provides a method of preparing a treated textile, comprising steps of:

(1) preparing a treatment liquid comprising a water- and oil-repellent agent and a stain blocking agent, (2) adjusting pH of the treatment liquid to at most 7, (3) applying the treatment liquid to a textile, (4) treating the textile with steam, and (5) washing the textile with water and dehydrating the textile, wherein the water- and oil-repellent agent comprises at least one fluorine-containing compound selected from the group consisting of a fluorine-containing polymer and a fluorine-containing low molecular weight compound, and the water- and oil-repellent agent or the treatment liquid contains a cationic emulsifying agent.

The present invention also provides a textile prepared by the above-mentioned method and a treatment liquid used in the above-mentioned method.

The procedure used in the present invention is an Exhaust process which comprises decreasing pH of a treatment liquid comprising a fluorine-containing compound, applying a treatment liquid to a textile, thermally treating the textile, washing the textile with water, and dehydrating the textile.

In the step (1) of the method of the present invention, the treatment liquid comprising the water- and oil-repellent agent and the stain blocking agent, which is applied to the textile, is prepared. The treatment liquid may be in the form of a solution or an emulsion, particularly an aqueous emulsion.

The stain blocking agent preferably include a phenol/formaldehyde condensate, an acrylic polymer and a mixture of the phenol/formaldehyde condensate and the acrylic polymer. Examples of the phenol/formaldehyde condensate include a sulfonated phenol resin. Examples of the acrylic polymer include a methacrylic acid-based polymer, for example, a homopolymer of methacrylic acid, and a copolymer of methacrylic acid such as methacrylic acid/butyl methacrylate copolymer and a methacrylic acid copolymer containing styrene.

The treatment liquid contains the cationic emulsifying agent. The water- and oil-repellent agent is prepared by using an emulsifying agent such as the cationic emulsifying agent, or the cationic emulsifying agent is added after the preparation of the water- and oil-repellent agent. The water- and oil-repellent agent, before the treatment liquid is prepared, may contain the cationic emulsifying agent, or the cationic emulsifying agent is added to the water- and oil-repellent agent to give the treatment liquid. In one of embodiments, the cationic emulsifying agent (or a salt) is preferably added after the preparation of the water- and oil-repellent agent (for example, after the preparation of an emulsion of the water- and oil-repellent agent).

The cationic emulsifying agent is generally a quarternary ammonium salt. Examples of the quarternary ammonium salt include an aliphatic quarternary ammonium salt, an aromatic quarternary ammonium salt and a heterocyclic quarternary ammonium salt.

Specific examples of the cationic emulsifying agent include an ammonium salt, for example, a monoalkyl ammonium salt, a dialkyl ammonium salt, a trialkyl ammonium salt, tetraalkyl ammonium salt (e.g., an alkyl trimethyl ammonium salt, a dialkyl dimethyl ammonium salt and a trialkyl methyl ammonium salt), a dipolyoxyethylene alkyl methyl ammonium salt, a dipolyoxyethylene alkyl amine, a fatty acid amide of dipolyoxyethylene, and an alkyl amine wherein the number of carbon atoms of the alkyl group is from 1 to 22 and the total number of oxyethylene groups in the molecule is from 2 to 40. The ammonium salt may be an ammonium halide such as ammonium chloride.

The amount of the cationic emulsifying agent contained in the treatment liquid may be from 0.01 to 300 parts by weight, for example, from 0.01 to 150 parts by weight, particularly from 0.1 to 80 parts by weight, especially from 4 to 50 parts by weight, based on 100 parts (solid content) by weight of the fluorine-containing compound. The amount of the cationic emulsifying agent, which is added to the water- and oil-repellent agent after the preparation of the water- and oil-repellent agent, may be from 0.01 to 300 parts by weight, for example, from 0.01 to 150 parts by weight, particularly from 0.1 to 80 parts by weight, based on 100 parts (solid content) by weight of the fluorine-containing compound.

The treatment liquid may contain a salt of organic acid, for example, a metal salt or ammonium salt of organic acid. The salt is a compound which is a hydrogen ion caused by the ionization of the organic acid is replaced with a cation (for example, a metal ion and an ammonium ion).

Examples of the organic acid include a carboxylic acid having a —COOH group, a sulfonic acid having a $—SO_3H$ group and a sulfate monoester having a $—OSO_3H$ group in molecule.

Examples of the carboxylic acid include formic acid, acetic acid, oxalic acid, phthalic acid, citric acid, propionic acid and butyric acid. Examples of the sulfonic acid include taurine, taurine derivatives (e.g., N-cocoylmethyltaurine) and alkylsulfonic acid (The carbon number of an alkyl group may be, for example, from 1 to 30, particularly from 5 to 20.) (e.g., tetradecenesulfonic acid). Examples of the sulfate monoester include monoalkyl sulfate (The carbon number of an alkyl group may be, for example, from 1 to 30, particularly from 5 to 20.), polyoxyalkylenealkylether sulfate (The carbon number of an oxyalkylene group may be 2 or 3, and the carbon number of an alkyl group may be, for example, from 1 to 30, particularly from 5 to 20.). Specific examples of the sulfate monoester include lauryl sulfate and polyoxyethylenelaurylether sulfate.

Examples of the cation in the salt include an metal ion and ammonium ion.

A metal forming the metal ion is a mono- to tetra-valent, particularly mono- to tri-valent metal. Examples of the metal include an alkaline metal (e.g., potassium and sodium), an alkaline earth metal (e.g., calcium and magnesium) and aluminum.

Examples of the salt containing the monovalent or divalent metal include HCOOLi, HCOOK, HCOONa, $(HCOO)_2Ca$, HCOOCs, $HCOONH_4$, $CH_3COOLi$, $CH_3COOK$, $(HCOO)_2Mg$, $(CH_3COO)_2Mg$, $(CH_3COO)_2Ca$, $(CH_3COO)_2Zn$, $(COOK)_2$ and $(COONa)_2$.

The amount of the salt may be from 0 to 500 parts by weight, for example, from 0.1 to 200 parts by weight, particularly from 0.5 to 50 parts by weight, per 1 part by weight (solid content) of the fluorine-containing compound.

In the step (2) in the method of the present invention, pH of the treatment liquid is brought to at most 7. pH of the treatment liquid is preferably at most 3, more preferably at most 2. pH can be decreased by addition of an acid such as an aqueous solution of citraconic acid and an aqueous solution of sulfamic acid to the treatment liquid.

In the step (3) of the method of the present invention, the treatment liquid is applied to the textile. The water- and oil-repellent agent can be applied to a substrate to be treated (that is, the textile) by known procedures. The application of the treatment liquid can be conducted by immersion, spraying and coating. Usually, the treatment liquid is diluted with water, and is adhered to surfaces of the substrate by a well-known procedure such as an immersion coating, a spray coating and a foam coating to a fabric (for example, a carpet cloth), a yarn (for example, a carpet yarn) or an original fiber. If necessary, the treatment liquid is applied together with a suitable crosslinking agent, followed by curing. It is also possible to add mothproofing agents, softeners, antimicrobial agents, flame retardants, antistatic agents, paint fixing agents, crease-proofing agents, etc. to the treatment liquid. The concentration of the water- and oil-repellent agent active component (that is, the fluorine-containing compound) in the treatment liquid contacted with the substrate may be from 0.05 to 10% by weight, based on the treatment liquid. The amount of the stain blocking agent may be from 50 to 10,000 parts by weight, for example, 50 to 5,000 parts by weight, based on 100 parts by weight of the fluorine-containing compound. The amount of the cationic emulsifying agent may be from 0.01 to 300 parts by weight, for example, 0.1 to 150 parts by weight, particularly from 0.1 to 80 parts by weight, based on 100 parts by weight of the fluorine-containing compound. The amount of the salt of organic salt may be from 0 to 500 parts by weight, for example, 0.1 to 200 parts by weight, based on 100 parts by weight of the fluorine-containing compound.

In the step (4) of the method of the present invention, the textile is thermally treated. The thermal treatment can be conducted by applying a steam (for example, 80 to 110° C.) to the textile under a normal pressure for e.g., 10 seconds to 30 minutes.

In the step (5) of the method of the present invention, the textile is washed with water and dehydrated. The thermally treated textile is washed with water at least once. Then, in order to remove excess water, the textile is dehydrated by a usual dehydration procedure such as a centrifuging and vacuuming procedure.

After the step (5), the textile can be dried.

The fluorine-containing compound is a fluorine-containing polymer and/or a fluorine-containing low molecular weight compound.

The fluorine-containing polymer may be a polymer comprising a repeating unit derived from a fluoroalkyl group-containing monomer such as a fluoroalkyl group-containing (meth)acrylate, a fluoroalkyl group-containing maleate or fumarate, or a fluoroalkyl group-containing urethane.

The fluoroalkyl group-containing (meth)acrylate ester may be of the formula:

$$Rf—A—OCOCR^{11}=CH_2$$

wherein Rf is a fluoroalkyl group having 3 to 21 carbon atoms, $R^{11}$ is a hydrogen atom or a methyl group, and A is a divalent organic group.

In the above formula, A may be a linear or branched alkylene group having 1 to 20 carbon atoms, a $—SO_2N(R^{21})R^{22}—$ group or a $—CH_2CH(OR^{23})CH_2—$ group ($R^{21}$ is an alkyl group having 1 to 10 carbon atoms, $R^{22}$ is a linear or branched alkylene group having 1 to 10 carbon atoms, and $R^{23}$ is a hydrogen atom or an acyl group having 1 to 10 carbon atoms).

Examples of the fluoroalkyl group-containing (meth)acrylate are as follows:

$$Rf—SO_2—\overset{\overset{R^1}{|}}{N}R^2OCOCR^3=CH_2 \quad (1)$$

$$Rf—(CH_2)_nOCOCR^3=CH_2 \quad (2)$$

$$Rf—CO\overset{\overset{R^1}{|}}{N}R^2OCOCR^3=CH_2 \quad (3)$$

$$Rf—CH_2\overset{\overset{OH}{|}}{C}HCH_2OCOCR^3=CH_2 \quad (4)$$

$$Rf—CH_2\overset{\overset{OCOR^3}{|}}{C}HCH_2OCOCR^3=CH_2 \quad (5)$$

$$Rf—O—Ar—CH_2OCOCR^3=CH_2 \quad (6)$$

wherein Rf is a fluoroalkyl group having 3 to 21 carbon atoms, $R^1$ is a hydrogen atom or an alkyl group having 1 to 10 carbon atoms, $R^2$ is an alkylene group having 1 to 10 carbon atoms, $R^3$ is a hydrogen atom or a methyl group, and Ar is arylene group optionally having a substituent, and n is an integer of 1 to 10.

Specific examples of the fluoroalkyl group-containing (meth)acrylate are as follows:

$CF_3(CF_2)_7(CH_2)_{10}OCOCH{=}CH_2$ $CF_3(CF_2)_7(CH_2)_{10}OCOC(CH_3){=}CH_2$ $CF_3(CF_2)_6CH_2OCOCH{=}CH_2$ $CF_3(CF_2)_8CH_2OCOC(CH_3){=}CH_2$ $(CF_3)_2CF(CF_2)_6(CH_2)_2OCOCH{=}CH_2$ $(CF_3)_2CF(CF_2)_8(CH_2)_2OCOCH{=}CH_2$ $(CF_3)_2CF(CF_2)_{10}(CH_2)_2OCOCH{=}CH_2$ $(CF_3)_2CF(CF_2)_6(CH_2)_2OCOC(CH_3){=}CH_2$ $(CF_3)_2CF(CF_2)_8(CH_2)_2OCOC(CH_3){=}CH_2$ $(CF_3)_2CF(CF_2)_{10}(CH_2)_2OCOC(CH_3){=}CH_2$ $CF_3CF_2(CF_2)_6(CH_2)_2OCOCH{=}CH_2$ $CF_3CF_2(CF_2)_8(CH_2)_2OCOCH{=}CH_2$ $CF_3CF_2(CF_2)_{10}(CH_2)_2OCOCH{=}CH_2$ $CF_3CF_2(CF_2)_6(CH_2)_2OCOC(CH_3){=}CH_2$ $CF_3CF_2(CF_2)_8(CH_2)_2OCOC(CH_3){=}CH_2$ $CF_3CF_2(CF_2)_{10}(CH_2)_2OCOC(CH_3){=}CH_2$ $CF_3(CF_2)_7SO_2N(CH_3)(CH_2)_2OCOCH{=}CH_2$ $CF_3(CF_2)_7SO_2N(C_2H_5)(CH_2)_2OCOCH{=}CH_2$ $(CF_3)_2CF(CF_2)_8CH_2CH(OCOCH_3)CH_2OCOC(CH_3){=}CH_2$ $(CF_3)_2CF(CF_2)_6CH_2CH(OH)CH_2OCOCH{=}CH_2$

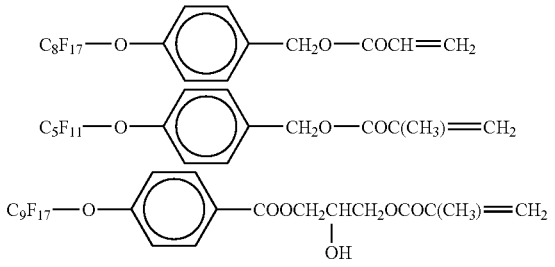

The fluorine-containing maleate or fumarate deriving the fluorine-containing polymer include, for example, an OH-containing fluorine-containing maleate represented by the formula:

(I)

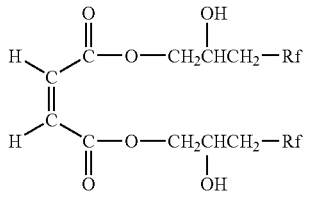

wherein Rf is a perfluoroalkyl group having 3 to 21 carbon atoms;

an OH-containing fluorine-containing fumarate ester represented by the formula:

(II)

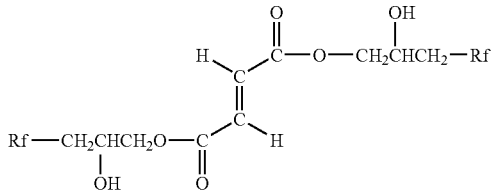

wherein Rf is a perfluoroalkyl group having 3 to 21 carbon atoms;

a fluorine-containing maleate ester represented by the formula:

(III)

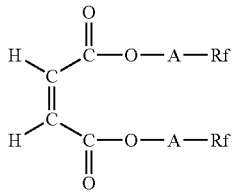

wherein Rf is a perfluoroalkyl group having 3 to 21 carbon atoms;

A is an alkylene group having 1 to 4 carbon atoms, or

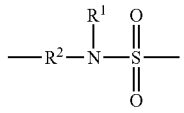

($R^1$ is a hydrogen atom or an alkyl group having 1 to 4 carbon atoms, and $R^2$ is an alkylene group having 1 to 4 carbon atoms); and a fluorine-containing fumarate ester represented by the formula:

(IV)

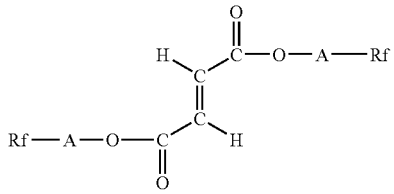

wherein Rf is a perfluoroalkyl group having 3 to 21 carbon atoms;

A is an alkylene group having 1 to 4 carbon atoms, or

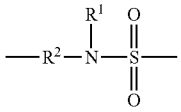

($R^1$ is a hydrogen atom or an alkyl group having 1 to 4 carbon atoms, and $R^2$ is an alkylene group having 1 to 4 carbon atoms).

The fluoroalkyl group-containing urethane monomer deriving the fluorine-containing polymer can be prepared by reacting:

(a) a compound having at least two isocyanate groups, (b) a compound having one carbon-carbon double bond and at least one hydroxyl group or amino group, and (c) a fluorine-containing compound one hydroxyl group or amino group.

Examples of the compound (a) include the followings:

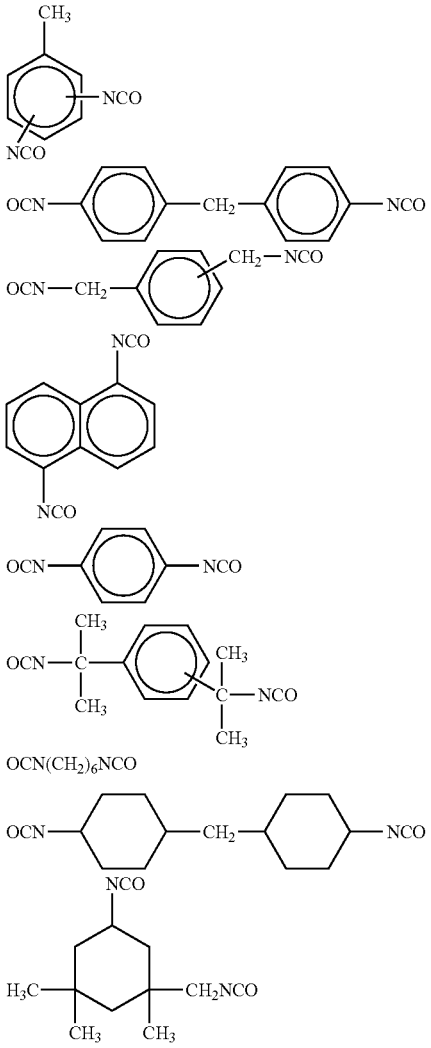

-continued

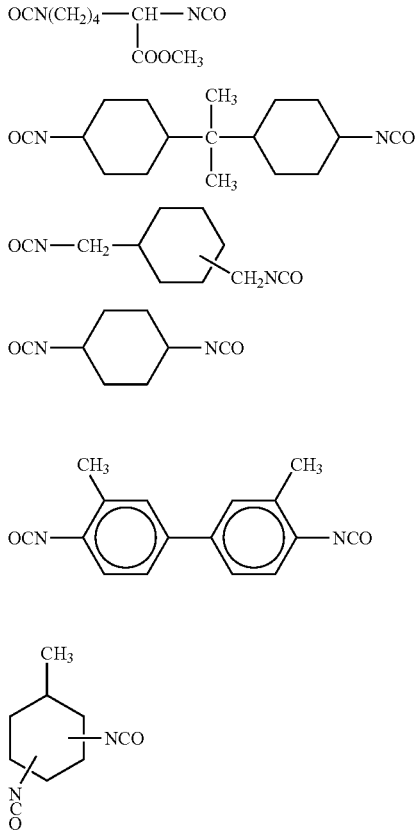

The compound (a) is preferably a diisocyanate. However, a triisocyanate and a polyisocyanate can be also used for the reaction.

For example, a trimer of diisocyanate, polymeric MDI (diphenylmethane diisocyanate) and an adduct of diisocyanate with a polyhydric alcohol such as trimethylol propane, trimethylol ethane and glycerol can be also used for the reaction.

Examples of the triisocyanate and the polyisocyanate are as follows:

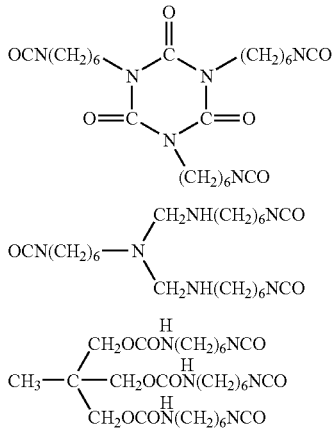

-continued

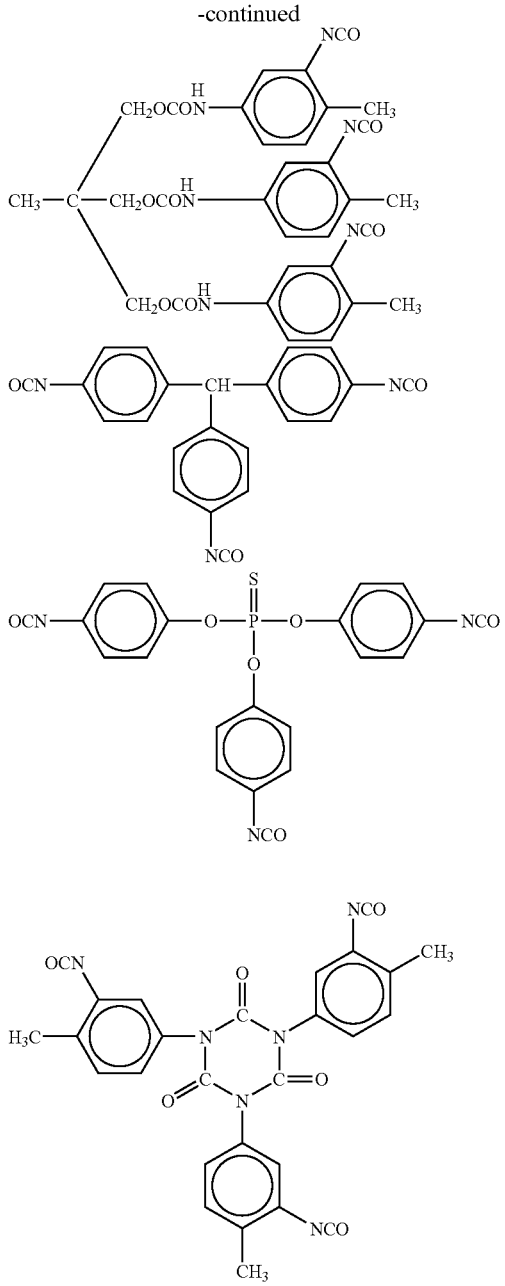

The compound (b) may be, for example, a compound of each of the formulas:

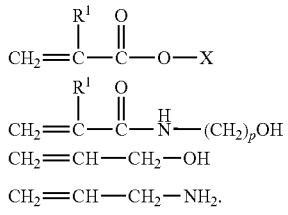

In the formula, $R^1$ is a hydrogen atom or a methyl group. Examples of X are as follows:

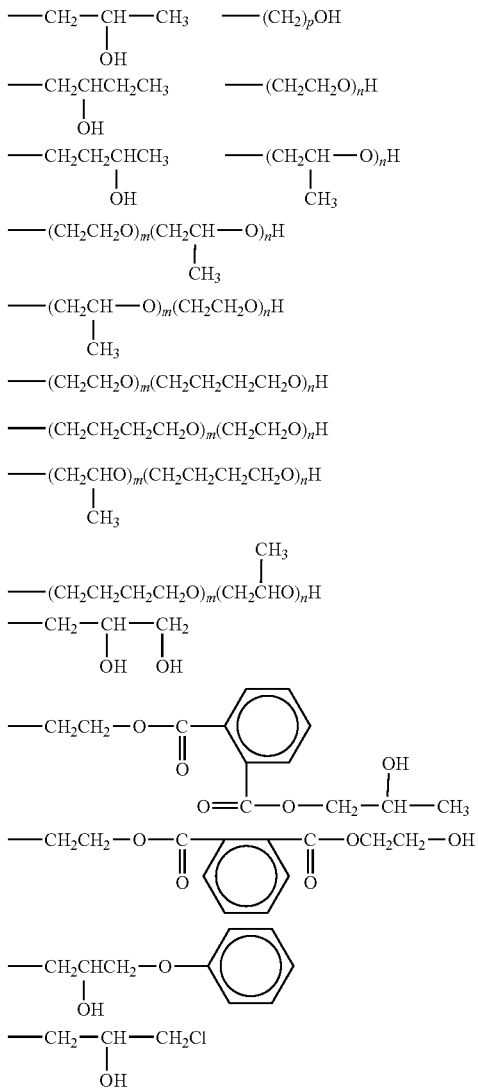

wherein m and n is a number of 1 to 300.

The compound (c) may be a compound of the formula:

$R_f—R^2—OH$, or $R_f—R^2—NH_2$ wherein Rf is a fluoroalkyl group having 1 to 22 carbon atoms, and $R^2$ is an alkylene group having 1 to 10 carbon atoms and may have a heteroatom.

Examples of the compound (c) may be the followings:

$CF_3CH_2OH$ $F(CF_2)_8CH_2CH_2OH$ $F(CF_2)_6(CH_2)_6OH$ $$F(CF_2)_8SO_2N(CH_3)CH_2CH_2OH$$

$$F(CF_2)_3CH_2NH_2$$

$$F(CF_2)_7CH_2NH_2$$

The compounds (a), (b) and (c) may be reacted such that when the compound (a) is a diisocyanate, both the compounds (b) and (c) are in amounts of 1 mol based on 1 mol of the compound (a); when the compound (a) is a triisocyanate, the compound (b) is in an amount of 1 mol and the compound (c) is in an amount of 2 mol based on 1 mol of the compound (a).

The fluorine-containing polymer constituting the water- and oil-repellent agent may comprise:

(I) a repeating unit derived from a monomer having a fluoroalkyl group, and (II) a repeating unit derived from a fluorine-free monomer.

The fluorine-containing polymer constituting the water- and oil-repellent agent may comprise:

(I) a repeating unit derived from a monomer having a fluoroalkyl group, (II) a repeating unit derived from a fluorine-free monomer, and (III) a repeating unit derived from a crosslinkable monomer.

Examples of the monomer having fluoroalkyl group constituting the repeating unit (I) include the same as the above-mentioned fluoroalkyl group-containing monomer such as the fluoroalkyl group-containing (meth)acrylate.

The repeating unit (II) is preferably derived from a fluorine-free olefinically unsaturated monomer. Non-limiting examples of a preferable monomer constituting the repeating unit (II) include, for example, ethylene, vinyl acetate, vinyl halide such as vinyl chloride, vinylidene halide such as vinylidene chloride, acrylonitrile, styrene, polyethyleneglycol (meth)acrylate, polypropyleneglycol (meth)acrylate, methoxypolyethyleneglycol (meth) acrylate, methoxypolypropyleneglycol (meth)acrylate, vinyl alkyl ether and isoprene.

The fluorine-containing polymer preferably contains vinyl halide or vinylidene halide.

The monomer constituting the repeating unit (II) may be a (meth)acrylate ester having an alkyl group. The number of carbon atoms of the alkyl group may be from 1 to 30, for example, from 6 to 30, e.g., from 10 to 30. For example, the monomer constituting the repeating unit (II) may be acrylates of the general formula:

$$CH_2{=}CA^3COOA^4$$

wherein $A^3$ is a hydrogen atom or a methyl group, and $A^4$ is an alkyl group represented by $C_nH_{2n+1}$ (n=1 to 30). The copolymerization with this monomer can optionally improve various properties such as water- and oil-repellency and soil releasability; cleaning durability, washing durability and abrasion resistance of said repellency and releasability; solubility in solvent; hardness; and feeling.

The crosslinkable monomer constituting the repeating unit (III) may be a fluorine-free vinyl monomer having at least two reactive groups. The crosslinkable monomer may be a compound having at least two carbon-carbon double bonds, or a compound having at least one carbon-carbon double bond and at least one reactive group.

Examples of the crosslinkable monomer include diacetoneacrylamide, (meth)acrylamide, N-methylolacrylamide, hydroxymethyl (meth)acrylate, hydroxyethyl (meth)acrylate, 3-chloro-2-hydroxypropyl (meth)acrylate, N,N-dimethylaminoethyl (meth)acrylate, N,N-diethylaminoethyl (meth)acrylate, butadiene, chloroprene and glycidyl (meth) acrylate, to which the crosslinkable monomer is not limited. The copolymerization with this monomer can optionally improve various properties such as water-repellency and soil releasability; cleaning durability and washing durability of said repellency and releasability; solubility in solvent; hardness; and feeling.

The fluorine-containing polymer preferably has a weight average molecular weight of 2,000 to 1,000,000.

Preferably, the amount of the repeating unit (I) is from 40 to 90% by weight, more preferably from 50 to 80% by weight, the amount of the repeating unit (II) is from 5 to 60% by weight, more preferably from 10 to 40% by weight, and the amount of the repeating unit (III) is from 0 to 10% by weight, more preferably 0.1 to 10% by weight, for example 0.5 to 10% by weight, based on the fluorine-containing polymer.

The fluorine-containing polymer in the present invention can be produced by any polymerization method, and the conditions of the polymerization reaction can be arbitrary selected. The polymerization method includes, for example, solution polymerization and emulsion polymerization. Among them, the emulsion polymerization is particularly preferred.

In the solution polymerization, there can be used a method of dissolving the monomers in an organic solvent in the presence of a polymerization initiator, replacing the atmosphere by nitrogen, and stirring the mixture with heating at the temperature within the range, for example, from 50° C. to 120° C. for 1 hour to 10 hours. Examples of the polymerization initiator include azobisisobutyronitrile, benzoyl peroxide, di-tert-butyl peroxide, lauryl peroxide, cumene hydroperoxide, t-butyl peroxypivalate and diisopropyl peroxydicarbonate. The polymerization initiator may be used in the amount within the range from 0.01 to 5 parts by weight based on 100 parts by weight of the monomers.

The organic solvent is inert to the monomers and dissolves them, and examples thereof include pentane, hexane, heptane, octane, cyclohexane, benzene, toluene, xylene, petroleum ether, tetrahydrofuran, 1,4-dioxane, methyl ethyl ketone, methyl isobutyl ketone, ethyl acetate, butyl acetate, 1,1,2,2-tetrachloroethane, 1,1,1-trichloroethane, trichloroethylene, perchloroethylene, tetrachlorodifluoroethane and trichlorotrifluoroethane. The organic solvent may be used in the amount within the range from 50 to 1,000 parts by weight based on 100 parts by weight of whole of the monomers.

In the emulsion polymerization, there can be used a method of emulsifying the monomers in water in the presence of a polymerization initiator and an emulsifying agent, replacing the atmosphere by nitrogen, and copolymerizing with stirring at the temperature within the range, for example, from 50° C. to 80° C. for 1 hour to 10 hours. As the polymerization initiator, for example, water-soluble initiators (e.g., benzoyl peroxide, lauroyl peroxide, t-butyl perbenzoate, 1-hydroxycyclohexyl hydroperoxide, 3-carboxypropionyl peroxide, acetyl peroxide, azobisisobutylamidine dihydrochloride, azobis-isobutyronitrile, sodium peroxide, potassium persulfate and ammonium persulfate) and oil-soluble initiators (e.g., azobisisobutyronitrile, benzoyl peroxide, di-tert-butyl peroxide, lauryl peroxide, cumene hydroperoxide, t-butyl peroxypivalate and diisopropyl peroxydicarbonate) are used.

The polymerization initiator may be used in the amount within the range from 0.01 to 5 parts by weight based on 100 parts by weight of the monomers.

In order to obtain a copolymer dispersion in water, which is superior in storage stability, it is desirable that the monomers are atomized in water by using an emulsifying device capable of applying a strong shattering energy (e.g., a high-pressure homogenizer and an ultrasonic homogenizer) and then polymerized with using the oil-soluble polymerization initiator. As the emulsifying agent, various emulsifying agents such as an anionic emulsifying agent, a cationic emulsifying agent and a nonionic emulsifying agent can be used in the amount within the range from 0.5 to 20 parts by weight based on 100 parts by weight of the monomers. It is preferable to use the cationic emulsifying agent as the emulsifying agent. When the monomers are not completely compatibilized, a compatibilizing agent capable of sufficiently compatibilizing them (e.g., a water-soluble organic solvent and a low-molecular weight monomer) is preferably added to these monomers. By the addition of the compatibilizing agent, the emulsifiability and copolymerizability can be improved.

Examples of the water-soluble organic solvent include acetone, methyl ethyl ketone, ethyl acetate, propylene glycol, dipropylene glycol monomethyl ether, dipropylene glycol, tripropylene glycol and ethanol. The water-soluble organic solvent may be used in the amount within the range from 1 to 50 parts by weight, e.g., from 10 to 40 parts by weight, based on 100 parts by weight of water.

The fluorine-containing low molecular weight compound may have a molecular weight of less than 2,000, for example, from 500 to 1,500 and may be a fluoroalkyl group-containing compound.

The fluorine-containing low molecular weight compound may be, for example, a fluoroalkyl group-containing urethane or a fluoroalkyl group-containing ester.

The fluoroalkyl group-containing urethane can be prepared by reacting (i) a compound having at least two isocyanate groups, with (ii) a fluorine-containing compound having one hydroxyl group, amino group or epoxy group.

Examples of the compound having at least two isocyanate groups (i) are the same as those of the above-mentioned compound having at least two isocyanate groups (a) used for the fluoroalkyl group-containing urethane monomer deriving the fluorine-containing copolymer.

Specific examples of the fluorine-containing compound having one hydroxyl group, amino group or epoxy group (ii) are as follows:

$CF_3CF_2(CF_2CF_2)_nCH_2CH_2OH$ $CF_3CF_2(CF_2CF_2)_nCH_2CH_2NH_2$ $CF_3CF_2(CF_2CF_2)_nCH_2CHCH_2$ (epoxide)

[n is from 2 to 8]

$CF_3CF(CF_2CF_2)_nCH_2CH_2OH$

-continued $CF_3CF(CF_2CF_2)_nCH_2CH_2NH_2$ $CF_3CF(CF_2CF_2)_nCH_2CHCH_2$ (epoxide)

[n is from 2 to 8]

$C_8F_{17}SO_2N(CH_3)CH_2CH_2OH$ $C_8F_{17}SO_2N(CH_3)CH_2CH_2NH_2$ $C_8F_{17}SO_2N(CH_3)CH_2CHCH_2$ (epoxide)

$C_8F_{17}SO_2N(C_2H_5)CH_2CH_2OH$ $C_8F_{17}SO_2N(C_2H_5)CH_2CH_2NH_2$ $C_8F_{17}SO_2N(C_2H_5)CH_2CHCH_2$ (epoxide)

The fluoroalkyl group-containing ester can be prepared by reacting:

(iii) a polybasic carboxylic acid compound, with (ii) a fluorine-containing compound having one hydroxyl group, amino group or epoxy group.

The polybasic carboxylic acid compound is a compound having at least 2, preferably 2 to 4 carboxylic acid groups.

Specific examples of the polybasic carboxylic acid compound are as follows:

$HOOC(CH_2)_nCOOH$

[n is 2, 4 or 6]

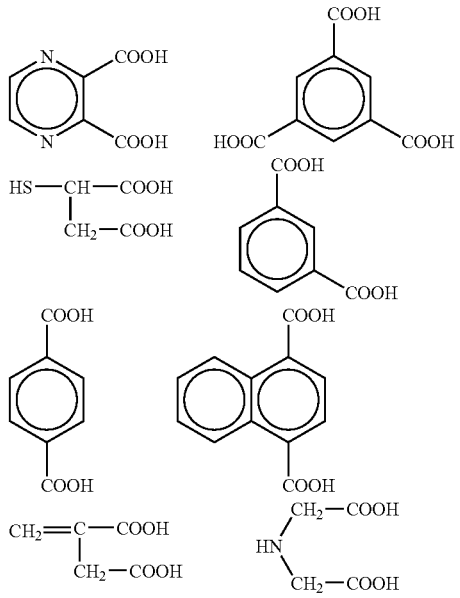

-continued

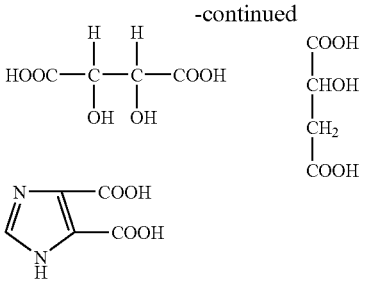

Examples of the fluorine-containing compound having one hydroxyl group, amino group or epoxy group (ii) forming the fluoroalkyl group-containing ester are the same as those of the above-mentioned fluorine-containing compound having one hydroxyl group, amino group or epoxy group (ii) forming the fluoroalkyl group-containing urethane.

The fluorine-containing compound may be the fluorine-containing polymer, the fluorine-containing low molecular weight compound, or a mixture of the fluorine-containing polymer and the fluorine-containing low molecular weight compound.

The amount of the fluorine-containing compound is at most 60% by weight, preferably from 1 to 40% by weight, for example, 1 to 30% by weight, based on the water- and oil-repellent agent. The amount of the emulsifier may be from 0.5 to 15 parts by weight, based on 100 parts by weight of the fluorine-containing compound.

The substrate to be treated in the present invention is preferably a textile, particularly a carpet. The textile includes various examples. Examples of the textile include animal- or vegetable-origin natural fibers such as cotton, hemp, wool and silk; synthetic fibers such as polyamide, polyester, polyvinyl alcohol, polyacrylonitrile, polyvinyl chloride and polypropylene; semisynthetic fibers such as rayon and acetate; inorganic fibers such as glass fiber, carbon fiber and asbestos fiber; and a mixture of these fibers. The method of the present invention can be suitably used in carpets made of nylon fibers, polypropylene fibers and/or polyester fibers (e.g., polyethylene terephthalate fibers), because the present invention provides excellent resistance to a detergent solution and brushing (mechanical).

The textile may be in any form such as a fiber, a yarn and a fabric. When the carpet is treated according to the method of the present invention, the carpet may be formed after the fibers or yarns are treated according to the present invention, or the formed carpet may be treated according to the present invention. The treatment liquid can be used in the state that the fluorine-containing compound is diluted to the content of 0.02 to 30% by weight, preferably 0.02 to 10% by weight.

PREFERRED EMBODIMENTS OF THE INVENTION

The following Examples further illustrate the present invention in detail but are not to be construed to limit the scope thereof. In the Examples, "%" is "% by weight" unless specified otherwise. The fluorine adhesion rate, water-repellency, oil-repellency and soil releasability of the carpets obtained in the Examples and Comparative Example were evaluated.

Test procedures of the fluorine adhesion rate, the water-repellency and the oil-repellency are as follows.

Fluorine Adhesion Rate

A combustion flask is sufficiently washed with pure water. Then, 15 mL of pure water is charged into the combustion flask, and the weight of the flask containing water is measured. The weight of pure waster is determined by deducting a previously measured weight of the combustion flask from the weight of flask containing water. A platinum basket is heated twice or thrice to fully evaporate water. 75 mg of a carpet pile is weighed on a KIMWIPE, which is folded with enclosing a combustion aid (30 mg) and is positioned in a platinum basket. Oxygen is blown into the combustion flask, and the piles are burned and decomposed, and absorbed into pure water contained in the flask. After the absorption for 30 minutes, 10 mL of an absorption liquid and 10 mL of a buffer liquid (50 mL of acetic acid, 50 g of sodium chloride, 0.5 g of trisodium citrate dihydrate, and 32 g of sodium hydroxide are added to water to give a total amount of 1 L) are charged into a plastic cup and an F ion is measured by an F ion meter with sufficiently stirring. A fluorine adhesion amount and a fluorine adhesion rate are calculated according to the following equation.

Fluorine adhesion amount [ppm]=(Measurement value [ppm]−Blank measurement value [ppm])×(Pure water weight [g]/Pile weight [mg])×1000

Fluorine adhesion rate (%)=(Fluorine adhesion amount after steam treatment, water wash, centrifugal dehydration and thermal curing treatment [ppm])/(Fluorine adhesion amount immediately after squeezed so that WPU (wet pick up) is 300% [ppm])

The fluorine adhesion rate is shown as "Exhaust-ability" in the following Tables.

Water-Repellency Test

A carpet treated with a water- and oil-repellent is stored in a thermo-hygrostat having a temperature of 21° C. and a humidity of 65% for at least 4 hours. A test liquid (isopropyl alcohol (IPA), water, and a mixture thereof, as shown in Table 1) which has been also stored at 21° C. is used. The test is conducted in an air-conditioned room having a temperature of 21° C. and a humidity of 65%. Droplets of the test liquid in an amount of 50 μL (5 droplets) are softly dropped by a micropipette on the carpet. If 4 or 5 droplets remain on the carpet after standing for 10 seconds, the test liquid passes the test. The water-repellency is expressed by a point corresponding to a maximum content of isopropyl alcohol (% by volume) in the test liquid which passes the test. The water-repellency is evaluated as twelve levels which are Fail, 0, 1, 2, 3, 4, 5, 6, 7, 8, 9 and 10 in order of a bad level to an excellent level.

TABLE 1

| | Water-repellency test liquid (% by volume) | |
|---|---|---|
| Point | Isopropyl alcohol | Water |
| 10 | 100 | 0 |
| 9 | 90 | 10 |
| 8 | 80 | 20 |
| 7 | 70 | 30 |
| 6 | 60 | 40 |
| 5 | 50 | 50 |
| 4 | 40 | 60 |
| 3 | 30 | 70 |
| 2 | 20 | 80 |
| 1 | 10 | 90 |
| 0 | 0 | 100 |

TABLE 1-continued

| Water-repellency test liquid | | |
|---|---|---|
| | (% by volume) | |
| Point | Isopropyl alcohol | Water |
| Fail | Inferior to isopropyl alcohol 0/water 100 | |

Oil-Repellency Test

A carpet treated with a water- and oil-repellent agent is stored in a thermo-hygrostat having a temperature of 21° C. and a humidity of 65% for at least 4 hours. A test liquid (shown in Table 2) which has been also stored at 21° C. is used. The test is conducted in an air-conditioned room having a temperature of 21° C. and a humidity of 65%. Droplets of the test liquid in an amount of 50 μL (5 droplets) are softly dropped by a micropipette on the carpet. If 4 or 5 droplets remain on the carpet after standing for 30 seconds, the test liquid passes the test. The oil-repellency is expressed by a point corresponding to a maximum content of isopropyl alcohol (% by volume) in the test liquid which passes the test. The oil-repellency is evaluated as nine levels which are Fail, 1, 2, 3, 4, 5, 6, 7 and 8 in order of a bad level to an excellent level.

TABLE 2

| Oil-repellency test | | |
|---|---|---|
| Point | Test liquid | Surface tension (dyne/cm, 25° C.) |
| 8 | n-Heptane | 20.0 |
| 7 | n-Octane | 21.8 |
| 6 | n-Decane | 23.5 |
| 5 | n-Dodecane | 25.0 |
| 4 | n-Tetradecane | 26.7 |
| 3 | n-Hexadecane | 27.3 |
| 2 | Mixture liquid of n-Hexadecane 35/nujol 65 | 29.6 |

TABLE 2-continued

| Oil-repellency test | | |
|---|---|---|
| Point | Test liquid | Surface tension (dyne/cm, 25° C.) |
| 1 | Nujol | 31.2 |
| Fail | Inferior to 1 | — |

Preparative Example 1

The types and amounts, shown in Table 3, of a fluorine-containing monomer, a fluorine-free monomer, a chain transfer agent, an emulsifier, an auxiliary solvent and water were mixed to prepare a mixture liquid.

This mixture liquid was heated at 60° C., and then homogenized by a high-pressure homogenizer. The resultant emulsion was charged in a 1 L autoclave and the dissolved oxygen was eliminated by nitrogen replacement. Then, vinyl chloride was charged in the amount shown in Table 3, and an initiator was charged in the amount shown in Table 3. The copolymerization reaction was conducted under stirring at 60° C. for 8 hours to give a vinyl chloride-containing copolymer emulsion. The emulsion was diluted with water to give an emulsion having a solid content of 30% by weight.

Preparative Example 2

The types and amounts, shown in Table 3, of a fluorine-containing monomer, a fluorine-free monomer, a chain transfer agent, an emulsifier, an auxiliary solvent and water were mixed to prepare a mixture liquid.

This mixture liquid was heated at 60° C., and then homogenized by a high-pressure homogenizer. The resultant emulsion was charged in a 1 L autoclave and the dissolved oxygen was eliminated by nitrogen replacement. Then, vinyl chloride was charged in the amount shown in Table 3, and an initiator was charged in the amount shown in Table 3. The copolymerization reaction was conducted under stirring at 60° C. for 8 hours to give a vinyl chloride-containing copolymer emulsion. The emulsion was diluted with water to give an emulsion having a solid content of 30% by weight.

TABLE 3

| Charge amount (g) | | | | |
|---|---|---|---|---|
| | Abbreviation | Name | Prep. Ex. 1 | Prep. Ex. 2 |
| Fluorine-containing monomer | SFA | $CH_2{=}CHCOOCH_2CH_2(CF_2CF_2)_nCF_2CF_3$ (Mixture of compounds wherein n is 3, 4 and 5 in weight ratio of 5:3:1) | 71.91 | 82.23 |
| Fluorine-free monomer | STA | Stearyl acrylate | 2.21 | 2.21 |
| | VCl | Vinyl chloride | 20.77 | 20.77 |
| | 2EHA | 2-Ethylhexyl acrylate | 13.17 | 4.39 |
| | DAAM | Diacetoneacrylamide | 2.08 | 2.08 |
| | TOPOLENEM | 3-Chloro-2-hydroxypropyl methacrylate | 0.49 | 0.49 |
| Chain transfer agent | LSH | n-Lauryl mercaptan | 0.16 | 0.16 |
| Nonionic emulsifying agent | BL-21 | Polyoxyethylene (21) lauryl ether | 5.41 | 5.41 |
| Cationic emulsifying agent | 2ABT | Di-harden tallow alkyl dimethyl ammonium chloride | 1.58 | 1.58 |
| | ETHOQUAD C/12 | Dipolyoxyethylene alkyl methyl ammonium chloride | 1.78 | 1.78 |

TABLE 3-continued

| | Abbreviation | Name | Charge amount (g) Prep. Ex. 1 | Prep. Ex. 2 |
|---|---|---|---|---|
| Initiator | V-50 | 2,2'-Azobis(2-amizinopropane) dihydrochloride | 0.76 | 0.76 |
| Auxiliary solvent | TPG | Tripropylene glycol | 30.00 | 30.00 |
| Water | | Deionized water | 179.27 | 177.73 |
| Solid content (%) | | | 33.00 | 33.00 |

Comparative Example 1

Water was added to a combination of 1 g of the emulsion prepared in Preparative Example 1 and 5 g of a stain blocking agent (a mixture of a phenol/formaldehyde condensate and polymethacrylic acid in a weight ratio of 50:50) (hereinafter referred to as "stain blocking agent") to dilute the mixture to the total amount of 950 g. A 10% aqueous sulfamic acid solution was added to the mixture so that pH of the mixture was 1.6 and then water was added to give the total amount of 1,000 g, resulting in a treatment liquid.

A carpet (20 cm×c 20 cm, 33.3 g, nylon-6, cut pile) was washed with water and was squeezed with a dehydrator to give a residual water amount of about 8.3 g (When 33.3 g of carpet absorbs 8.3 g of water, WPU (wet pick up) is about 25%). 100 g of the treatment liquid was charged in a vessel having a size of 20 cm×20 cm, and the carpet was immersed in the treatment liquid in the state that a carpet pile side is downward. The carpet was urged downward so that the liquid is homogeneous on whole of the carpet.

Then, a normal-pressure steamer treatment (temperature: 100° C. to 107° C.) was conducted for 60 seconds under the state that a pile surface was upward. The carpet was lightly rinsed with 5 L of water and then centrifugal dehydration was conducted to give a WPU amount of 25%. Finally, the carpet was thermally cured at 110° C. for 10 minutes.

The measurement of exhaustability was conducted. The results are shown in Table 4.

Example 1

Each of 2.5 g, 10 g, 50 g and 100 g of ETHOQUAD C/12 (manufactured by Lion Akzo Co. Ltd.) (cationic emulsifying agent) was added to and mixed with 100 g of the emulsion prepared in Preparative Example 1 to give a liquid.

Water was added to a combination of each of 1.025 g, 1.1 g, 1.5 and 2 g of the resultant liquid and 5 g of the stain blocking agent to have the total amount of 950 g. A 10% aqueous sulfamic acid solution was added to the mixture so that pH of the mixture was 1.6, and then the mixture was diluted with water to give the total amount of 1,000 g, resulting in a treatment liquid. In the same manner as in Comparative Example 1, the carpet was treated with the treatment liquid.

The measurement of the exhaustability was conducted. The results are shown in Table 4.

Example 2

Each of 2.5 g, 10 g, 50 g and 100 g of CATION AB (manufactured by NOF Corp.) (cationic emulsifying agent) was added to and mixed with 100 g of the emulsion prepared in Preparative Example 1 to give a liquid.

Water was added to a combination of each of 1.025 g, 1.1 g, 1.5 and 2 g of the resultant liquid and 5 g of the stain blocking agent to have the total amount of 950 g. A 10% aqueous sulfamic acid solution was added to the mixture so that pH of the mixture was 1.6, and then the mixture was diluted with water to give the total amount of 1,000 g, resulting in a treatment liquid. In the same manner as in Comparative example 1, the carpet was treated with the treatment liquid.

The measurement of the exhaustability was conducted. The results are shown in Table 4.

TABLE 4

| | Additive Type | (wt %) | Exhaustability (%) |
|---|---|---|---|
| Com. Ex. 1 | None | 0 | 74 |
| Ex. 1 | ETHOQUAD C/12 | 2.5 | 90 |
| | | 10 | 95 |
| | | 50 | 92 |
| | | 100 | 89 |
| Ex. 2 | CATION AB | 2.5 | 85 |
| | | 10 | 92 |
| | | 50 | 98 |
| | | 100 | 84 |

Comparative Example 2

Water was added to a combination of 1 g of the emulsion prepared in Preparative Example 2 and 5 g of the stain blocking agent to have the total amount of 950 g. A 10% aqueous sulfamic acid solution was added to the mixture so that pH of the mixture was 1.7, and then the mixture was diluted with water to give the total amount of 1,000 g, resulting in a treatment liquid. In the same manner as in Comparative Example 1, the carpet was treated with the treatment liquid.

The measurement of the exhaustability, the water-repellency test and the oil-repellency test was conducted. The results are shown in Table 5.

Comparative Example 3

Water was added to a combination of 1 g of the emulsion prepared in Preparative Example 2 and 5 g of the stain blocking agent to have the total amount of 950 g. A 10% aqueous sulfamic acid solution was added to the mixture so that pH of the mixture was 2, and then the mixture was diluted with water to give the total amount of 1,000 g, resulting in a treatment liquid. In the same manner as in Comparative Example 1, the carpet was treated with the treatment liquid.

The measurement of the exhaustability, the water-repellency test and the oil-repellency test was conducted. The results are shown in Table 5.

Example 3

10 of ETHOQUAD C/12 was added to 100 g of the emulsion prepared in Preparative Example 2 to give a liquid.

Water was added to a combination of 1.1 g of the resultant liquid and 5 g of the stain blocking agent to give the total amount of 950 g. A 10% aqueous sulfamic acid solution was added to the mixture so that pH of the mixture was 1.7, and then the mixture was diluted with water to give the total amount of 1,000 g, resulting in a treatment liquid. In the same manner as in Comparative Example 1, the carpet was treated with the treatment liquid.

The measurement of the exhaustability, the water-repellency test and the oil-repellency test was conducted. The results are shown in Table 5.

Example 4

10 of ETHOQUAD C/12 was added to 100 g of the emulsion prepared in Preparative Example 2 to give a liquid.

Water was added to a combination of 1.1 g of the resultant liquid and 5 g of the stain blocking agent to give the total amount of 950 g. A 10% aqueous sulfamic acid solution was added to the mixture so that pH of the mixture was 2, and then the mixture was diluted with water to give the total amount of 1,000 g, resulting in a treatment liquid. In the same manner as in Comparative Example 1, the carpet was treated with the treatment liquid.

The measurement of the exhaustability, the water-repellency test and the oil-repellency test was conducted. The results are shown in Table 5.

Comparative Example 4

Water was added to a combination of 1 g of the emulsion prepared in Preparative Example 1 and 5 g of the stain blocking agent to have the total amount of 950 g. A 10% aqueous sulfamic acid solution was added to the mixture so that pH of the mixture was 2.6, and then the mixture was diluted with water to give the total amount of 1,000 g, resulting in a treatment liquid. In the same manner as in Comparative Example 1, the carpet was treated with the treatment liquid.

The measurement of the exhaustability, the water-repellency test and the oil-repellency test was conducted. The results are shown in Table 6.

Comparative Example 5

Water was added to a combination of 1 g of the emulsion prepared in Preparative Example 1, 5 g of the stain blocking agent and 30 g of a 10% aqueous sodium formate solution to have the total amount of 950 g. A 10% aqueous sulfamic acid solution was added to the mixture so that pH of the mixture was 2.6, and then the mixture was diluted with water to give the total amount of 1,000 g, resulting in a treatment liquid. In the same manner as in Comparative Example 1, the carpet was treated with the treatment liquid.

The measurement of the exhaustability, the water-repellency test and the oil-repellency test was conducted. The results are shown in Table 6.

Example 5

10 of ETHOQUAD C/12 was added to 100 g of the emulsion prepared in Preparative Example 1 to give a liquid. Water was added to a combination of 1.1 g of the resultant liquid and 5 g of the stain blocking agent to give the total amount of 950 g. A 10% aqueous sulfamic acid solution was added to the mixture so that pH of the mixture was 2.6, and then the mixture was diluted with water to give the total amount of 1,000 g, resulting in a treatment liquid. In the same manner as in Comparative Example 1, the carpet was treated with the treatment liquid.

The measurement of the exhaustability, the water-repellency test and the oil-repellency test was conducted. The results are shown in Table 6.

Example 6

10 of ETHOQUAD C/12 was added to 100 g of the emulsion prepared in Preparative Example 1 to give a liquid. Water

TABLE 5

| | | Additive | | Exhaustability | Water- | Oil- |
|---|---|---|---|---|---|---|
| | | Type | (wt %) | (%) | repellency | repellency |
| Com. Ex. 2 | pH 1.7 | None | 0 | 67 | 4 | 4 |
| Com. Ex. 3 | pH 2 | | | 43 | 3 | 2 |
| Ex. 3 | pH 1.7 | ETHOQUAD | 10 | 87 | 6 | 5 |
| Ex. 4 | pH 2 | C/12 | | 53 | 3 | 4 |

was added to a combination of 1.1 g of the resultant liquid, 5 g of the stain blocking agent and 30 g of a 10% aqueous sodium formate solution to give the total amount of 950 g. A 10% aqueous sulfamic acid solution was added to the mixture so that pH of the mixture was 2.6, and then the mixture was diluted with water to give the total amount of 1,000 g, resulting in a treatment liquid. In the same manner as in Comparative Example 1, the carpet was treated with the treatment liquid.

The measurement of the exhaustability, the water-repellency test and the oil-repellency test was conducted. The results are shown in Table 6.

TABLE 6

| | Additive | | Sodium | Exhaustability | Water- | Oil- |
|---|---|---|---|---|---|---|
| | Type | (wt %) | formate | (%) | repellency | repellency |
| Com. Ex. 4 | None | 0 | – | 15 | Fail | Fail |
| Com. Ex. 5 | | | + | 77 | 9 | 4 |
| Ex. 5 | ETHOQUAD | 10 | – | 20 | 1 | Fail |
| Ex. 6 | C/12 | | + | 91 | 10 | 5 |

What is claimed is:

1. A method of preparing a treated textile, comprising steps of:

(1) preparing an emulsion of a water- and oil-repellent agent, (2) adding a cationic emulsifying agent to the prepared water- and oil-repellent agent to obtain a treatment liquid comprising the water- and oil-repellent agent and a stain blocking agent, (3) adjusting pH of the treatment liquid to at most 7, (4) applying the treatment liquid to a textile, (5) treating the textile with steam, and (6) washing the textile with water and dehydrating the textile, wherein the cationic emulsifying agent is selected from the group consisting of a monoalkyl ammonium salt, a dialkyl ammonium salt, a trialkyl ammonium salt, a dipolyoxyethylene alkyl methyl ammonium salt, a dipolyoxyethylene alkyl amine, a fatty acid amide of dipolyoxyethylene, and an alkyl amine wherein the number of carbon atoms of the alkyl group is from 1 to 22 and the total number of oxyethylene groups in the molecule is from 2 to 40, wherein the water- and oil-repellent agent comprises at least one fluorine-containing compound which is a fluorine-containing polymer comprising:

(I) a repeating unit derived from a monomer having a fluoroalkyl group, represented by the formula:

$$Rf—A—OCOCR^{11}=CH_2$$

wherein Rf is a fluoroalkyl group having 3 to 21 carbon atoms, $R^{11}$ is a hydrogen atom or a methyl group, and A is a divalent organic group, and (II) a repeating unit derived from a fluorine-free monomer which comprises at least one selected from a fluorine-free monomer which comprises at least one selected from the group consisting of vinyl halide and vinylidene halide, and wherein the cationic emulsifying agent is added in an amount of 33.3 to 333.3 parts by weight based on 100 parts (solid content) by weight of the fluorine-containing compound.

2. The method according to claim 1, wherein the water- and oil-repellent agent or the treatment liquid further contains a salt of an organic acid.

3. The method according to claim 2, wherein the organic acid in the salt of organic acid is a carboxylic acid, sulfonic acid or sulfate monoester.

4. The method according to claim 2, wherein the salt of organic acid is a metal salt or an ammonium salt.

5. The method according to claim 1, wherein the fluorine-containing polymer further comprises:

(III) a repeating unit derived from a crosslinkable monomer.

6. The method according to claim 1, wherein the stain blocking agent is a phenol/formaldehyde condensate, an acrylic polymer or a mixture of the phenol/formaldehyde condensate and the acrylic polymer.

7. The method according to claim 1, wherein pH of the treatment liquid is adjusted to at most 4 in the step (3).

8. The method according to claim 1, wherein the amount of the repeating unit (I) is from 40 to 90% by weight, the amount of the repeating unit (II) is from 10 to 60% by weight, based on the fluorine-containing polymer.

9. The method according to claim 5, wherein the amount of the repeating unit (III) is from 0.1 to 10% by weight, based on the fluorine-containing polymer.

10. The method according to claim 1, wherein the textile is a carpet.

11. The method according to claim 10, wherein the carpet comprises a nylon fiber, a polypropylene fiber and/or a polyester fiber.

12. A treatment liquid usable in a method of treating a textile, comprising steps of:

(1) preparing an emulsion of a water- and oil-repellent agent, (2) adding a cationic emulsifying agent to the prepared water- and oil-repellent agent to obtain a treatment liquid comprising the water- and oil-repellent agent and a stain blocking agent, (3) adjusting pH of the treatment liquid to at most 7, (4) applying the treatment liquid to a textile, (5) treating the textile with steam, and (6) washing the textile with water and dehydrating the textile, wherein the cationic emulsifying agent is selected from the group consisting of a monoalkyl ammonium salt, a dialkyl ammonium salt, a trialkyl ammonium salt, a dipoloxyethylene alkyl methyl ammonium salt, a dipolyoxyethylene alkyl amine, a fatty acid amide of dipolyoxyethylene, and an alkyl amine wherein the number of carbon atoms of the alkyl group is from 1 to 22 and the total number of oxyethylene groups in the molecule is from 2 to 40, wherein the water- and oil-repellent agent comprises at least one fluorine-containing compound which is a fluorine-containing low molecular weight compound comprising:

(I) a repeating unit derived from a monomer having a fluoroalkyl group, represented by the formula:

$$Rf—A—OCOCR^{11}=CH_2$$

wherein Rf is a fluoroalkyl group having 3 to 21 carbon atoms, $R^{11}$ is a hydrogen atom or a methyl group, and A is a divalent organic group, and (II) a repeating unit derived from a fluorine-free monomer which comprises at least one selected from a fluorine-free monomer which comprises at least one selected from the group consisting of vinyl halide and vinylidene halide, and wherein the cationic emulsifying agent is added in an amount of 33.3 to 333.3 parts by weight based on 100 parts (solid content) by weight of the fluorine-containing compound.

* * * * *